United States Patent [19]

Kao

[11] 4,377,808

[45] Mar. 22, 1983

[54] INFRARED INTRUSION ALARM SYSTEM

[75] Inventor: Lin Kao, Hong Kong, Hong Kong

[73] Assignee: Sound Engineering (Far East) Limited, Kowloon, Hong Kong

[21] Appl. No.: 172,802

[22] Filed: Jul. 28, 1980

[51] Int. Cl.[3] ..... G08B 23/00; G08B 17/12

[52] U.S. Cl. ..... 340/527; 340/522; 340/529; 340/565; 340/600

[58] Field of Search ..... 340/527, 565, 529, 528, 340/522, 530, 541, 540, 566, 567, 587, 506–511, 600; 307/293, 294, 231, 577, 525, 529, 590, 591; 361/195; 250/200, 208, 209

[56] References Cited

U.S. PATENT DOCUMENTS

| | | | |
|---|---|---|---|
| 3,691,558 | 9/1972 | Hoard et al. | 340/529 |
| 3,858,192 | 12/1974 | Fischer | 340/528 |
| 4,179,691 | 12/1979 | Keller | 340/527 |

*Primary Examiner*—Donnie L. Crosland

*Attorney, Agent, or Firm*—Stevens, Davis, Miller & Mosher

[57] ABSTRACT

An improved dual-sensor infrared intrusion alarm system includes a motion discriminator that renders the system responsive to only radiation-emanating objects that are moving through the system's scope of surveillance. A positive or negative sensor signal is developed depending on the relative amounts of radiation impinging on the sensors. A switching amplifier selectively discharges one of two capacitors depending on the polarity of the sensor signal. The voltages across the capacitors are coupled to the inputs of a voltage comparator and the capacitor recharge time constants are selected so that an alarm is indicated only when the length of the time interval between the occurrence of a sensor signal of a given polarity and the subsequent occurrence of a sensor signal of the opposite polarity is within prescribed limits, for example, two seconds.

10 Claims, 1 Drawing Figure

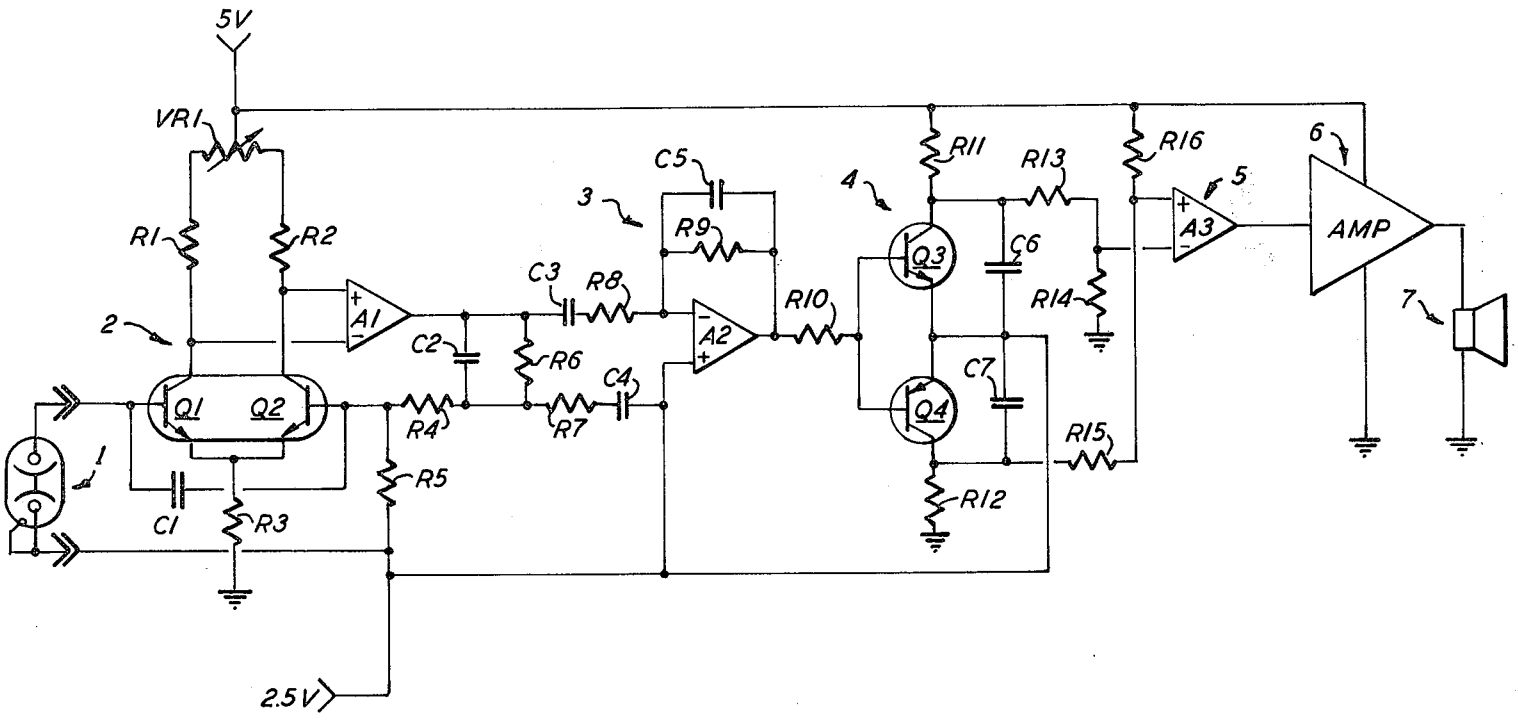
AMP
A3
A2
A1
Q1
Q2
Q3
Q4
R1
R2
R3
R4
R5
R6
R7
R8
R9
R10
R11
R12
R13
R14
R15
R16
VR1
C1
C2
C3
C4
C5
C6
C7
5V
2.5V
1
2
3
4
5
6
7

INFRARED INTRUSION ALARM SYSTEM

TECHNICAL FIELD

This invention relates to infrared intrusion alarm systems and more particularly to a dual sensor system that includes circuitry for detecting a moving radiation-emanating object in a manner that provides enhanced immunity to false alarm indications.

BACKGROUND ART

Early attempts at passive intrusion detection systems typically utilized a single infrared sensor to detect radiation emanating from a heat-generating object, typically a human body. The sensor supplies an electrical signal as a result of a change in incident radiation and that signal can be used to trigger an alarm. The primitive infrared intrusion systems suffered from inadequate sensitivity, that is, the change in level of radiation required to reliably trigger the alarm was greater than desired. Furthermore, the single-sensor systems were susceptible to false triggering or false alarm indications and were known to be responsive to irrelevant changes in ambient lighting conditions.

More sophisticated intrusion alarms have used a plurality of infrared sensors and spherical mirrors to collect the infrared radiation and either reflect or refract that radiation upon the individual sensors. See, for example, Mortensen, "Fire and Intrusion's Detection and Alarm Apparatus", U.S. Pat. No. 4,052,716, Oct. 4, 1977. In such systems each sensor can be made more or less sensitive to light emanating from a particular location. (See, Mortensen, supra at columns 3–6 for a thorough explanation of one such system.) By appropriately processing electrical signals derived from the sensors, significant improvements can be made in the performance of the intrusion detector. A particularly helpful technique is to trigger the alarm in response to only differential changes in the sensor signals and to limit the bandwidth of the sensor and/or processing circuitry. Nevertheless, even the more sophisticated systems can be expected to generate spurious alarms if, for example, incident ambient light fails on only one sensor in a dual sensor system. This invention is directed to an intrusion system that discriminates between radiation emanating from stationary and moving objects and triggers an alarm in response to only moving objects.

DISCLOSURE OF THE INVENTION

The subject invention is an intrusion alarm system that includes at least two infrared sensors, each responsive to radiation emanating from different locations. The sensors are coupled to a differential amplifier that develops a sensor signal that may be either positive or negative with respect to a quiescent voltage, depending on the relative amounts of radiation impinging on the sensors. A motion discriminator is included and develops an alarm signal only when the time delay between the occurrance of a sensor signal of one polarity and the subsequent occurrence of a signal at the opposite polarity is within a prescribed limit.

In this manner the intrusion alarm system is sensitive to only radiation-emanating bodies that are moving across the system's scope of surveillance, thereby rendering enhanced immunity to false alarm indications that may be caused by spurious or random variations in the ambient level of radiation.

BRIEF DESCRIPTION OF THE DRAWING

The sole drawing is a circuit diagram of the subject intrusion alarm system.

BEST MODE FOR CARRYING OUT THE INVENTION

For a better understanding of the present invention, together with other and further objects, advantages and capabilities thereof, reference is made to the following disclosure and appended claims in connection with the above-described drawing.

1. Circuit Description

Referring now to the drawing, a dual-element infrared sensor 1 is coupled between the first and second inputs, that is, between the respective bases of transistors Q1 and Q2, of a differential amplifier 2; the differential amplifier includes, in addition to Q1 and Q2, an operational-amplifier (op-amp), A1. Q1 and Q2 have their collectors respectively coupled through resistors R1 and R2 to opposite ends of a variable resistor VR1. The wiper of VR1 is coupled to a 5-volt supply. For reasons that will be made apparent below the wiper of VR1 is adjusted to provide the desired quiescent voltages at the collectors of Q1 and Q2.

The emitters of Q1 and Q2 are coupled through a common emitter resistor R3 to a reference potential, ground. The collectors of Q1 and Q2 are respectively coupled to the noninverting, (+), and inverting, (−), inputs of op-amp A1. The output of A1 is coupled through a feedback network including C2, R6 and R4 to the base of Q2. The base of Q2 is coupled through a resistor R5 to a low impedance, 2.5-volt reference potential that may be constructed in any one of a number of conventional manners. The reference source is also coupled to one output of the dual-element infrared sensor.

The output of the differential amplifier is coupled through a series-connected RC network, C3 and R8, to the input of a bandpass amplifier 3 at the inverting input of an op-amp A2. C3 and R8 largely determine the low frequency response of amplifier 3 and in this embodiment the low frequency cutoff may be estimated to be on the order of approximately 3 Hz. The 2.5-volt reference potential is coupled to the noninverting input of A2 and establishes the quiescent DC voltage at its output. The output of A2 is also coupled through a feedback network comprising a parallel-connected resistor R9 and capacitor C5 to its inverting input. The output of the bandpass amplifier is coupled to the input of the motion discriminator 4 through a resistor R10.

The motion discriminator includes a switching amplifier transistors (Q3, Q4), a first voltage divider (resistors R11, R13, R14), a second voltage divider (resistors R12, R15, R16), a voltage comparator (op-amp A3) and first and second capacitors (C6, C7). The motion discriminator has an input terminal, at the commonly connected basis of Q3 and Q4, coupled to the amplified and filtered sensor signal and a reference terminal, at the commonly connected emitters of Q3 and Q4, coupled to the 2.5-volt reference. The first output of the switching amplifier is coupled through R11 to the 5-volt supply, through R13 to the inverting input of A3, and through C6 to the reference terminal. The second output of the switching amplifier, at the collector of Q4, is coupled through R12 to ground and through R15 to the noninverting input of A3, and through C7 to the reference terminal. The inverting input and noninverting inputs of A3 are respectively coupled through R14 and R16 to ground and the 5-volt supply. The output of A3 is coupled through a buffer amplifier 6 to an alarm device in the form of a loudspeaker 7.

In a specific embodiment of the subject intrusion detector, values for the components described above are as given:

R1, R2=150 Kohm
R3=68 Kohm
R4=470 Kohm
R5, R8=10 Kohm
R6, R9=1 Mohm
R7=15 Kohm
R10=4.7 Kohm
R11, R12=270 Kohm
R13, R15=120 Kohm
R14, R16=680 Kohm
C1=100 pf
C2, C5=0.01 uf
C3=4.7 uf
C4=22 uf
C6, C7=10 uf It is, of course, to be understood that these values are merely exemplary and are intended solely to facilitate an understanding of the subject invention.

2. Circuit Operation in General

As shown in the drawing, the elements of the infrared sensor are series connected in an opposing manner so that the differential voltage across the bases of Q1 and Q2 (Q1 with respect to Q2) will be positive, negative or zero depending on whether the radiation impinging the upper element (the element connected to the base of Q1) is greater than, lesser than or equal to the radiation impinging on the lower element.

With equal amounts of (or no) radiation impinging on the upper and lower elements, the output of A1 will be quiescent DC voltage having a value largely determined by R4, R5 and R6. As a radiation-emanating body laterally traverses the scope of surveillance so that radiation impinges initially on the upper element, then on both elements and finally the bottom element alone, the voltage at the output of A1 will initially be positive with respect to, then equal to, and finally negative with respect to the quiescent DC level. Although the voltage at the output of A1 will, under all conditions, be strictly positive, for the purposes of this description as well as the appended claims it will be considered to be of positive polarity when its value is greater than the quiescent DC level and of negative polarity when its value is less than the quiescent DC level. A dual polarity voltage supply system would allow voltages at the output of A1 that could assume positive or negative values as understood in the strict sense. It is clear that such a system is contemplated by and within the scope of the subject invention. The time constant established by C2 and R6 limit the differential amplifiers frequency response and therefore the maximum rate at which it can respond to changing sensor output signals. R7 and C4 are included in the differential amplifier feedback loop and serve to affect the low frequency cutoff.

The amplified and frequency-limited sensor signal is coupled to the inverting input of A2 through C3 and R8, which, in a conventional fashion also affect the low frequency response of the intrusion detector.

3.A. Motion Discriminator—No Sensor Signal

The emitters of Q3 and Q4 are at all times clamped to 2.5 volts by virtue of the voltage reference. With no differential sensor signal (i.e. either no infrared radiating body or equal radiation impinging both sensors) the voltage at the bases of Q3 and Q4 will also be at 2.5 volts. This results from the application of the 2.5 volt reference to the noninverting input of A2 and from the large degree of DC feedback, limited largely by the leakage resistance of C4, around its feedback loop. Q3 and Q4 will both be cut off and, for values of resistances given in the table above. The voltages at the collector of Q3, inverting input of A3, noninverting input of A3 and collector of Q4 will be 3.74, 3.18, 1.82 and 1.26 volts respectively. Because, in order for an alarm signal to be generated the voltage at the noninverting input of the amplifier must be greater than the voltage at the inverting input, no alarm will be generated.

3.B. Motion Discriminator—Positive Sensor Signal

With the reception of a positive sensor signal (corresponding to a greater amount of radiation impinging on the upper element), the output of A2 will become greater than the 2.5 volt reference level. Q3 will become saturated, thereby discharging C6 to 2.5 volts. The voltage at the inverting input will drop to 2.125 volts, but because this is still greater than the 1.82 volts remaining at the noninverting input, no alarm will be indicated. When the positive sensor signal is removed, Q3 will cease conducting and C6 will charge back up to 3.74 volts with a time-constant determined by the network comprising R11, R13, R14 and C6. The voltage at the inverting input of A2 will eventually return to 3.18 volts.

3.C. Motion Discriminator—Negative Sensor Signal

With the reception of a negative sensor signal (corresponding to a greater amount of radiation impinging on the lower element), the output of A2 will become less than the 2.5 volt reference level. Q4 will become saturated (and Q3 cutoff) thereby discharging C7 to 2.5 volts. The voltage at the noninverting input of A3 will increase to 2.875 volts but because this is still less than the 3.18 volts present at the noninverting input, no alarm will be indicated. When the negative sensor signal is removed C7 will charge back down to 1.26 volts with a time-constant determined by the network comprising R12, R15, R16 and C7. The voltage at the noninverting input of A3 will eventually return to 1.82 volts.

3.D. Motion Discriminator—Moving Object

For the above discussion it is clear that the reception of a negative sensor signal within a sufficiently short period of time after the removal of a positive sensor signal (or, analogously, a positive signal following a negative signal) will cause the output of A3 to become more positive and an alarm will be indicated. This is true after the removal of a positive sensor signal, the voltage at the inverting input of the A3 will return from 2.125 volts to 3.18 volts at a rate determined by the relevant time constant. If a negative signal is received before the voltage at the inverting input has increased to 2.875 volts, the voltage at the noninverting input will be greater than the voltage at the inverting input and the output of A3 will go from approximately 0 to 5 volts and an alarm will be indicated. For the values illustrated above, the two elements of the infrared sensor must be energized within approximately two seconds of each other.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

This invention is useful in all types of intrusion alarm systems in which enhanced immunity to false alarm indication resulting from spurious or random variations in ambient radiation is achieved by rendering the system responsive only to moving radiation-emanating bodies.

What is claimed is:

1. An intrusion alarm system comprising:

at least first and second sensors responsive to radiation emanating from spatially distinct locations;

means for subtractively combining the output signals of said sensors to produce an output signal having a first or second signal level respectively on opposite sides of a quiescent operating level, depending on the radiation impinging on said sensors; and, motion discriminating means for receiving said output signal from said combining means and determining the time delay between the occurrence of an output signal of one signal level and the subsequent occurrence of an output signal of the opposite signal level, said motion discriminating means activating an alarm device only when said determined time delay is within a predetermined limit indicating movement of a radiation emanating object between spatially distinct locations.

2. An instrusion alarm system as defined in claim 1 wherein the motion discriminating means comprises a switching amplifier having an input coupled to the output of said combining means, a common terminal coupled to a first reference potential and first and second outputs respectively coupled through first and second capacitances to the common terminal.

3. An intrusion alarm system as defined in claim 2 wherein the motion discriminating means further comprises:

comparator means having first and second inputs respectively coupled to the first and second outputs of the switching amplifier, said comparator means selectively activating the alarm device and first and second voltage dividers each coupled between a supply voltage and a second reference potential, wherein said first divider is coupled to the first output of the switching amplifier and to the first input of the comparator means and wherein said second divider is coupled to the second output of the switching amplifier and to the second input of the comparator means.

4. An intrusion alarm system as defined in claim 3 wherein the first voltage divider comprises:

a first resistor coupled between the supply voltage and the first output of the switching amplifier;

a second resistor coupled between the first output of the switching amplifier and the first input of the comparator means, and a third resistor coupled between the first input of the comparator means and the second reference potential and wherein the second voltage divider comprises:

a fourth resistor coupled between the second reference potential and the second output of the switching amplifier, a fifth resistor coupled between the second output of the switching amplifier and the second input of the comparator means and a sixth resistor coupled between the second input of the comparator means and the supply voltage.

5. An intrusion alarm system as defined in either claim 2 or claim 3 wherein the switching amplifier comprises first and second semiconductor switching devices so arranged and constructed that the first switching device is rendered conductive and discharges the first capacitance in response to sensor signals of one signal level and the second switching device is rendered conductive and discharges the second capacitance in response to sensor signals of the opposite signal level.

6. An intrusion alarm system comprising:

first and second sensors responsive to radiation emanating from spatially distinct locations;

a differential amplifier means having inputs respectively coupled to the outputs of said first and second sensors, said amplifier means developing at its output a sensor signal that may assume either of two signal levels on opposite sides of a quiescent signal level, as determined by the radiation incident on the sensors, a motion discriminator having an input coupled to receive the output of said differential amplifier means and an output adapted to be coupled to an alarm, said motion discriminator operating so as to activate the alarm only when the time delay between the occurrence of a sensor signal of one level at the output of the differential amplifier means and the subsequent occurrence of a sensor signal of an opposite level at the output of the differential amplifier means is within a prescribed time limit.

7. An intrusion alarm system as defined in claim 6 wherein the motion discriminator comprises:

a switching amplifier having an input coupled to the output of said differential amplifier means, a common terminal coupled to a first reference potential, and first and second outputs;

first and second time-constant networks each coupled between a voltage supply and a second reference potential and having first and second inputs respectively coupled to the first and second outputs of the switching amplifier;

comparator means for activating an alarm device, said comparator means having a first input coupled to an output of the first time-constant network and a second input coupled to the output of the second time-constant network.

8. An intrusion alarm system as defined in claim 7 wherein the time-constant networks each comprise:

a capacitance coupled between an output of the switching amplifier and the common terminal; and a voltage divider coupled between the voltage supply and the second reference potential and coupled to an output of the switching amplifier and an input of the comparator means.

9. An intrusion alarm system as defined in claim 8 above wherein the voltage divider each comprises:

a first resistor coupled at one end to an output of the switching amplifier;

a second resistor coupled at one end to an input of the comparator means; and a third resistor coupled between an output of the switching amplifier and an input of the comparator means.

10. An intrusion alarm system as defined in claim 9 wherein the switching amplifier comprises first and second semiconductor switching devices so arranged and constructed that the first switching device is rendered conductive, thereby discharging the first capacitance, in response to an output of said differential amplifier means of one level and the second switching device is rendered condutive, thereby discharging the second capacitance, in response to an output of said differential amplifier means of the opposite level.

* * * * *